US009752408B2

(12) United States Patent
Robben

(10) Patent No.: US 9,752,408 B2
(45) Date of Patent: Sep. 5, 2017

(54) FLUID AND CRACK CONTAINMENT COLLAR FOR WELL CASINGS

(71) Applicant: Stephen C. Robben, Victoria, KS (US)

(72) Inventor: Stephen C. Robben, Victoria, KS (US)

( * ) Notice: Subject to any disclaimer, the term of this patent is extended or adjusted under 35 U.S.C. 154(b) by 441 days.

(21) Appl. No.: 14/456,645

(22) Filed: Aug. 11, 2014

(65) Prior Publication Data

US 2016/0040502 A1 Feb. 11, 2016

(51) Int. Cl.
*E21B 33/14* (2006.01)

(52) U.S. Cl.
CPC ..... *E21B 33/14* (2013.01)

(58) Field of Classification Search
CPC ..... E21B 33/14
See application file for complete search history.

(56) References Cited

U.S. PATENT DOCUMENTS 1,649,846 A 11/1927 Neelands
1,914,251 A 6/1933 Gordon
3,064,731 A 11/1962 Hall
3,110,346 A 11/1963 Spurlock et al.
3,131,768 A * 5/1964 Chancellor ..... E21B 33/14 166/181
3,387,656 A 6/1968 Guest et al.
3,387,661 A 6/1968 Evans et al.
3,486,758 A * 12/1969 Alexander, Jr. ..... E21B 33/14 277/615
3,802,500 A 4/1974 Schmidt
3,958,639 A 5/1976 Daniel
3,976,139 A * 8/1976 Wilder ..... E21B 23/00 166/214
4,440,226 A 4/1984 Suman, Jr.
4,495,997 A 1/1985 Scott et al.
4,716,965 A 1/1988 Bol et al.
5,060,723 A * 10/1991 Sutherland ..... E21B 33/04 166/202
5,078,211 A * 1/1992 Swineford ..... E21B 43/10 166/202

(Continued)

OTHER PUBLICATIONS

Engineer Said Zaki Elzeghaty, "Cement seal units eliminates the inter-zonal communication", presented in the 15th Middle East Oil & Gas Show and Conference (MEOS 2007) on Mar. 14 in Manama, Kingdom of Bahrain, Technology & Solutions, published Apr. 2007—Issue 4, pp. 16-17.

*Primary Examiner* — Giovanna C Wright
(74) *Attorney, Agent, or Firm* — Erickson Kernell IP, LLC

(57) ABSTRACT

A crack and fluid containment collar and system for well casings to prevent micro-annulus crack propagation and fluid flow therethrough. The collar includes an annular wall extending coaxially from a first end thereof to form a trough around a casing on which the collar is disposed. A plurality of circumferential channels is provided in an exterior surface of the collar and an interior surface of the annular wall. Pairs of the collar are coupled to the casing in opposite orientations; one above and one below a containment zone with their annular flanges directed toward the zone. When encased in cement, the collars impede propagation of cracks (and fluid/gas flow therethrough) along the surfaces of the casing and collars. A second end of the collar is tapered to direct crack formation away from the collar and casing.

17 Claims, 4 Drawing Sheets

(56) References Cited

U.S. PATENT DOCUMENTS

| | | | | |
|---|---|---|---|---|
| 5,791,416 | A * | 8/1998 | White | E21B 17/1042 166/177.4 |
| 7,631,695 | B2 | 12/2009 | Schafer et al. | |
| 7,690,437 | B2 | 4/2010 | Guillot et al. | |
| 2010/0300689 | A1 | 12/2010 | McRobb et al. | |
| 2011/0214861 | A1 | 9/2011 | Rogers et al. | |
| 2013/0014938 | A1 | 1/2013 | Esmail | |
| 2014/0102727 | A1* | 4/2014 | Northam | E21B 33/126 166/387 |
| 2014/0138088 | A1* | 5/2014 | Ramon | E21B 33/1212 166/288 |

* cited by examiner

FLUID AND CRACK CONTAINMENT COLLAR FOR WELL CASINGS

BACKGROUND

Micro-annulus cracking or channeling is a major issue faced in the installation and use of oil and gas wells. Micro-annulus cracks are often formed between a well casing and a surrounding sleeve of concrete. The cracks are thought to result from fluctuations in the well casing, e.g. expansion/contraction thereof as pressures and temperatures change inside of the well casing change during installation and use. The cracks or channels provide a pathway through which fluids and/or gases can travel along the exterior of the well casing which may result in cross-contamination between vertically stratified zones of the well.

Oil and gas wells, among other well types, are commonly formed by first drilling a borehole in the ground and into a desired underground formation, e.g. a geologic formation holding oil, gas, or other resources. A well casing, which commonly comprises a steel pipe, is inserted into the borehole. Cement is then pumped through the well casing to fill the borehole around the well casing from the bottom up. A fluid, such as water or saline, is pumped into the well casing to displace the cement from within the well casing and a predetermined period of time is allowed to elapse to allow the cement to cure. The fluid can then be removed from the well casing to enable final preparation of the well casing before production of the desired resource begins. Such final preparations may include perforating and formation stimulation, eg. Acidizing and fracking the well at predetermined depths associated with the underground formations, among others.

Installation and removal of cement and fluid in the well casing may cause the well casing to expand and/or contract diametrically. However, the surrounding cement sleeve is not subjected to the same expansion/contraction, at least not to the same degree, as the well casing. The well casing may thus pull away from the cement sleeve at one or more locations along the length and/or circumference of the casing to form one or more micro-annulus cracks or channels therebetween. For example, removal of the displacement fluid from the well casing reduces or eliminates the hydrostatic pressure within the well casing and may thus allow the well casing to at least partially contract away from the cement sleeve.

A variety of attempts have been made to prevent micro-annulus cracking and/or to prevent fluid or gas movement through the cracks. For example, U.S. Pat. No. 3,064,731 to Hall discloses baffles that are installed on a well casing above and below a fracturing point. The baffles extend radially outward from the casing and aids in blocking or diverting a shockwave produced during fracturing of the well casing to protect adjacent areas of the casing and surrounding concrete from damage.

U.S. Pat. No. 3,387,656 to Guest et al. describes an elastomeric ring that is applied to the exterior of the well casing to provide a flexible seal between the concrete and the casing to block fluid flow therebetween. U.S. Pat. No. 3,802,500 to Schmidt describes fluid diverting baffles that include a cylindrical sleeve with a resilient annular flange extending radially outward therefrom. The outer diameter of the annular flange is slightly larger than bore hole such that the flange will be slightly upwardly cupped when installed in the borehole and can be forced into a downwardly cupped orientation by applying a pressure differential to allow downward fluid flow without excessive restriction.

Several attempts employ expandable or inflatable components or materials that fill a space between a well casing and sides of the bore hole or cement sleeve. For example, U.S. Pat. No. 4,440,226 to Suman describes inflatable sleeves that are placed on the casing to form a seal between the casing and the wall of the borehole. U.S. Pat. No. 4,716,965 to Bol et al. describes elastomeric foam sheaths that are installed on the exterior of a well casing to seal off any spacing between the casing and surrounding concrete. U.S. Pat. No. 7,631,695 to Schafer et al. describes an isolation tool that is disposed on the exterior wall of a casing and that includes a pair of chambers. The chambers contain two separate materials that can be dispensed from the isolation tool to mix and form a barrier to fluid flow, e.g. the materials chemically react when mixed. And U.S. Pat. No. 7,690,437 to Guillot et al. describes a device that is disposed on the exterior of a casing and that can be expanded after insertion of the casing in a bore hole to cause the device to fill the annular space around the casing and to inhibit the flow of fluids.

What is needed is a device that is simple in construction, is easily installed on a well casing, and that prevents or resists formation of continuous micro-annulus cracks or channels that extend between vertically stratified zones of a wellbore and that obstructs travel of fluids and gases between such zones.

SUMMARY

Embodiments of the invention are defined by the claims below, not this summary. A high-level overview of various aspects of the invention is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a fluid and crack containment collar that is couple-able to a well casing to prevent or resist formation of continuous micro-annulus cracks between vertically stratified zones of a wellbore and to prevent travel of fluids and gases between such zones.

The containment collar comprises a generally cylindrical ring with a bore extending coaxially therethrough. The bore is configured to enable the collar to be disposed on a well casing and to be welded or otherwise coupled thereto. The ring is divided along its coaxial length into a coupling section and a flanged section. In the coupling section the bore has a diameter just larger than the outer diameter of the well casing. In the flanged section, the bore is provided with a larger diameter to form a flange or annular wall that is spaced apart from an outer wall of the well casing. An outer surface of the ring and outer and inner surfaces of the annular wall include one or more grooves or channels extending circumferentially about the collar and perpendicular to the axis of the collar.

The containment collar is preferably employed as a set of two collars; one collar positioned on the well casing at a location that is vertically above a zone of the wellbore and a second collar positioned below the zone. The upper collar is oriented with the annular wall directed downward in an inverted, downwardly cupped orientation, while the lower collar is oriented with the annular wall directed upward toward the upper collar. Cement pumped into the space surrounding the casing surrounds the collars and infiltrates between the annular wall and the sidewall of the casing. The collars are not substantially subjected to expansion/contraction of the well casing and thus remain bonded to the cement, e.g. do not substantially form micro-annulus cracks therebetween. Accordingly, the collars obstruct and/or prevent formation of micro-annulus cracks between zones located above or below the collars. The circumferential channels in the collars provide additional bonding surfaces and features between the collars and cement to reduce the likelihood of crack formation therebetween. If cracks do form between the collars and the cement, the channels also present a tortuous path that obstructs crack propagation and fluid/gas flow.

DESCRIPTION OF THE DRAWINGS

Illustrative embodiments of the invention are described in detail below with reference to the attached drawing figures, and wherein.

DETAILED DESCRIPTION

Figure 1:
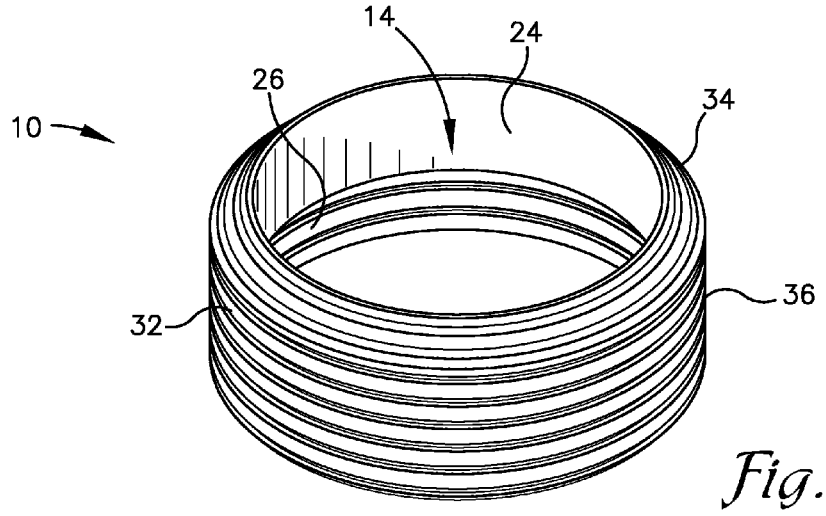
FIG. 1 is a perspective view of a fluid and crack containment collar depicted in accordance with an embodiment of the invention.
Figure 2:
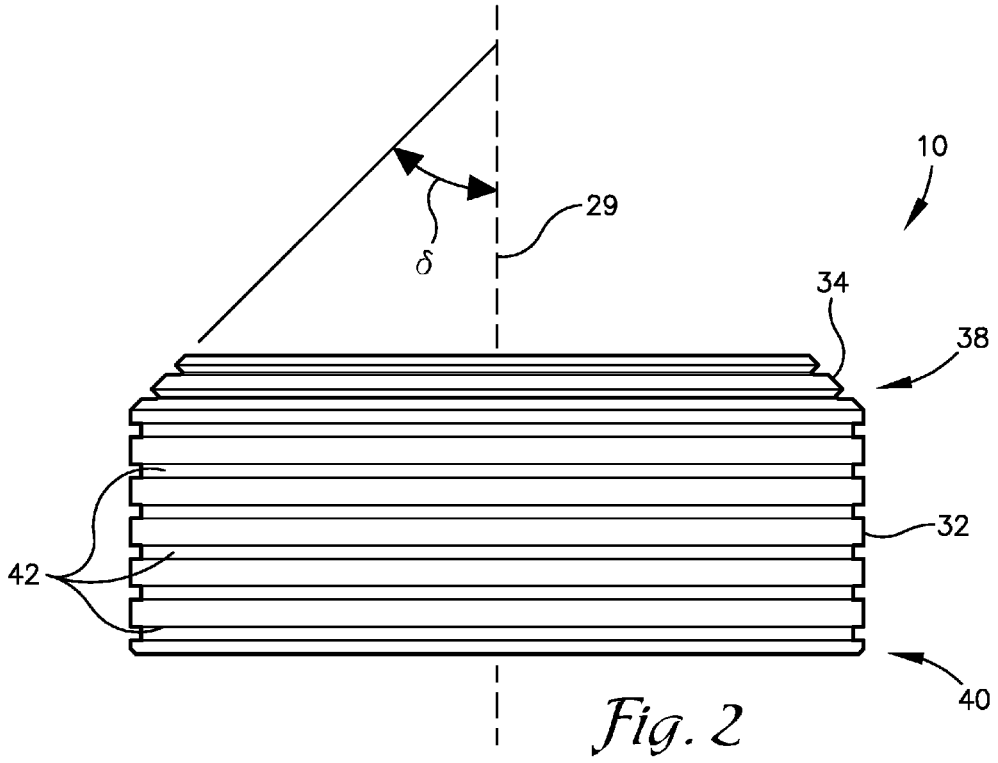
FIG. 2 is a side elevational view of the fluid and crack containment collar of FIG. 1.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

With reference to FIGS. 1-5, a fluid and crack containment collar 10 is described in accordance with an embodiment of the invention. The collar 10 is described herein with respect to use in oil and gas well implementations. However, embodiments of the invention are not so limited. Embodiments of the collar 10 might be employed, for example, in wells for water or other natural resources, or in other well or pipe applications in which micro-annulus cracking or channeling occurs without departing from the scope of embodiments of the invention described herein.

The containment collar 10 comprises a generally cylindrical body or ring 12 with a bore 14 extending axially or coaxially therethrough. The collar 10 is preferably constructed as a unitary steel component, such as by casting or machining or both, but can be made from other available materials and manufacturing processes. The ring 12 includes a coupling section 16 and a flanged section 18 arranged at opposite ends along its length. In the coupling section 16, the bore 14 has a first radial dimension that is just larger than an exterior radial dimension of a well casing 20 on which the collar 10 is to be disposed such that the ring 12 is disposable on the casing 20 and slideably locatable in a desired position along the length of the casing 20. The first radial dimension of the ring 12 may be selected to account for variations or artifacts on an exterior surface 22 of the casing 20, such as weld beads, seams, or dimensional variations, among others. The first radial dimension may be sized just larger than the exterior dimensions of the well casing 20 such that the coupling section 16 of the collar 10 abuts against the casing 20 or is snug or friction-fit on the casing 20. Or the first radial dimension may be somewhat larger to enable free-sliding of the collar 10 along the casing 20. An interior surface 24 of the coupling section 16 of the ring 12 is generally smooth and is configured to substantially abut or lie adjacent and in close proximity to the exterior surface 22 of the casing 20.

The bore 14 includes a second radial dimension in the flanged section 18 of the ring 12. The second radial dimension is larger than the first radial dimension such that an interior surface 26 of the flanged section 18 is spaced apart from the exterior surface 22 of the casing 20. The flanged section 18 thus forms a cylindrical, annular wall 28 extending from the circumference of coupling section 16 of the collar 10 and in a direction generally parallel to the central axis 29 of the collar 10. An end of the coupling section 16 that is proximate to the annular wall 28 forms a shoulder 30 that is interior to the annular wall 28. The annular wall 28 and the shoulder 30, together with exterior surface 22 of the casing 20, thus form a trough 31 about the circumference of the casing 20.

An outer surface 32 of the collar 10 includes a tapered portion 34 and a circumferential face 36. The tapered portion 34 extends from a first end 38 of the ring 12, opposite the annular wall 28, at an angle θ relative to the central axis 29 of the collar 10. The angle θ is preferably approximately 45° but can be a somewhat larger or smaller angle, e.g. θ can be between about 30° and about 60° or between about 20° and about 70°. In one embodiment (not shown), the collar 10 does not include the tapered portion 34; the first end 38 is instead substantially square or blunted. The circumferential face 36 extends from the tapered portion 34 along the exterior of the ring 12 to an opposite second end 40 of the collar 10 and is aligned substantially parallel to the axis 29 of the collar 10. It is foreseen that the circumferential face 36 may be disposed at an angle to the axis 29 so as to provide the collar 10 with an at least partially conical form.

A plurality of circumferentially extending grooves or channels are formed in the outer surface 32 of the collar 10 and the interior surface 26 of the flanged section 18. The channels 42 are preferably rectangular in cross-section and are substantially evenly spaced apart along the outer surface 32 of the collar 10 and the interior surface 26 of the annular wall 28. The channels 42 can, however, have any cross-sectional shape, form, dimensions, and arrangement without departing from the scope of embodiments of the invention described herein. For example, the channels 32 might comprise triangular or semi-circular grooves or the channels 32.

Or one or more of the channels 32 might be varied in dimensions and/or form. The dimension and form of the channels 32 are substantially uniform about the circumference of the collar 10 but can be varied. Raised ridges or protuberances may be employed instead of or in addition to the channels 32. In the embodiment shown in FIG. 3, one or more channels 32 are also formed in the shoulder 30. Edges or corners of the channels 32 and of the collar 10 may be chamfered or rounded.

Figure 3:
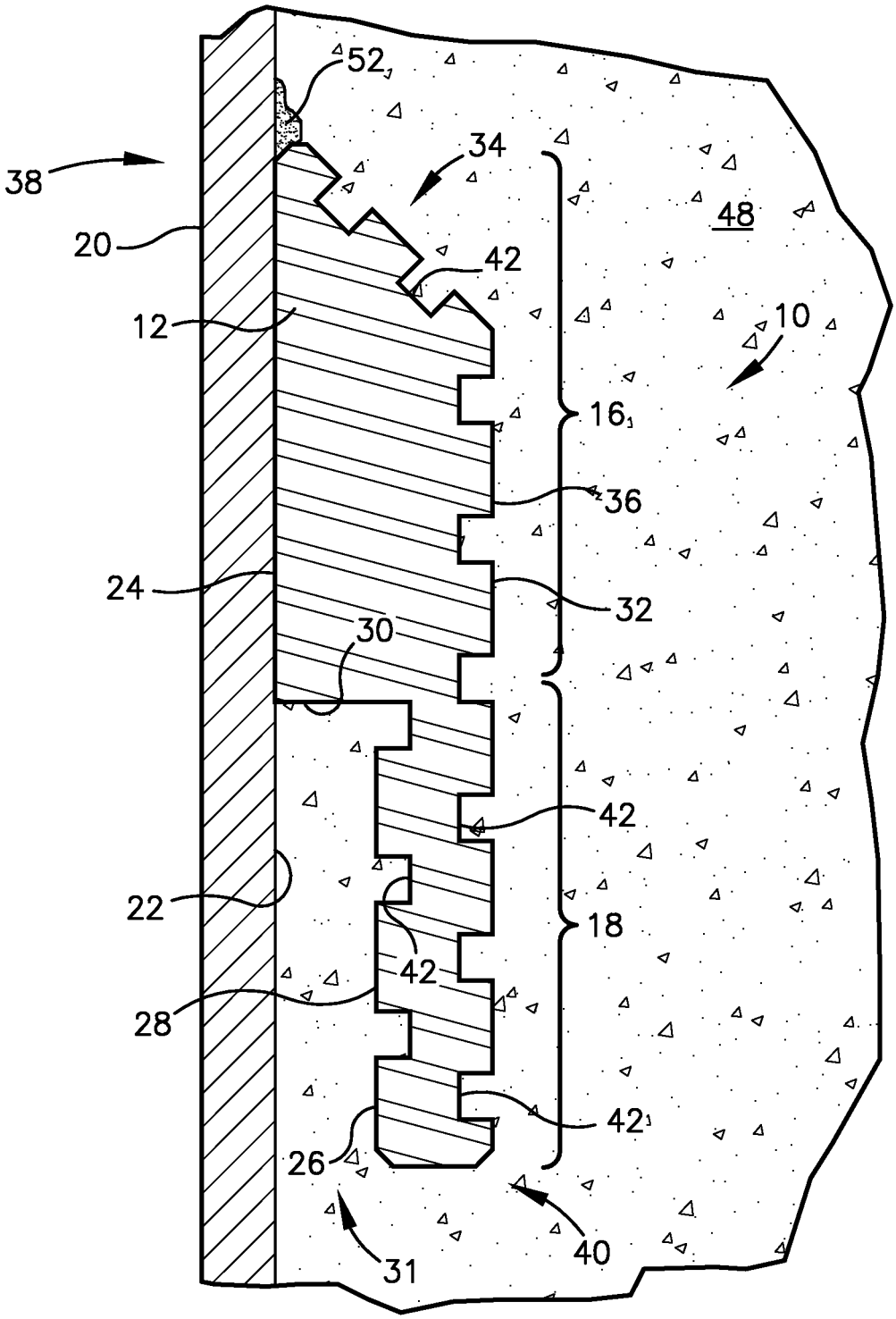
FIG. 3 is a cross-sectional elevational view of one side of the fluid and crack containment collar of FIG. 1 shown in an installed condition on a well casing and within a cement sleeve in a borehole in accordance with an embodiment of the invention.
Figure 4:
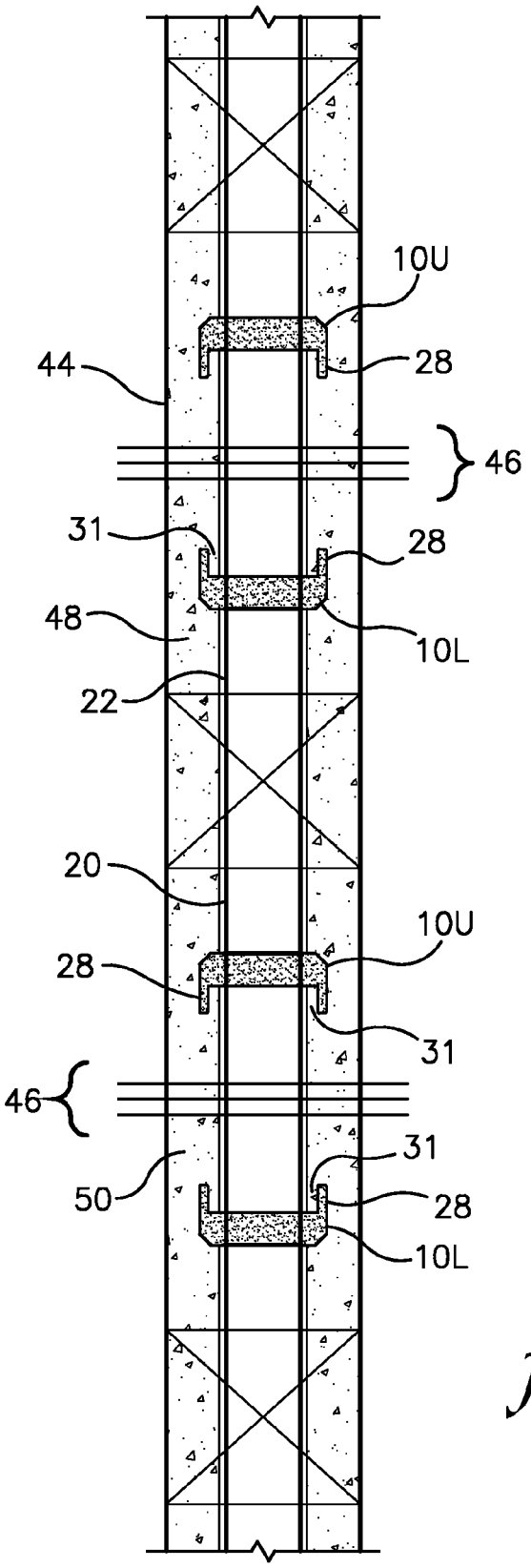
FIG. 4 is a cross-sectional elevational view of one side of the fluid and crack containment collar of FIG. 1 shown in an installed condition on a well casing and within a cement sleeve in a borehole and depicting cracks formed in the cement in accordance with an embodiment of the invention.
Figure 5:
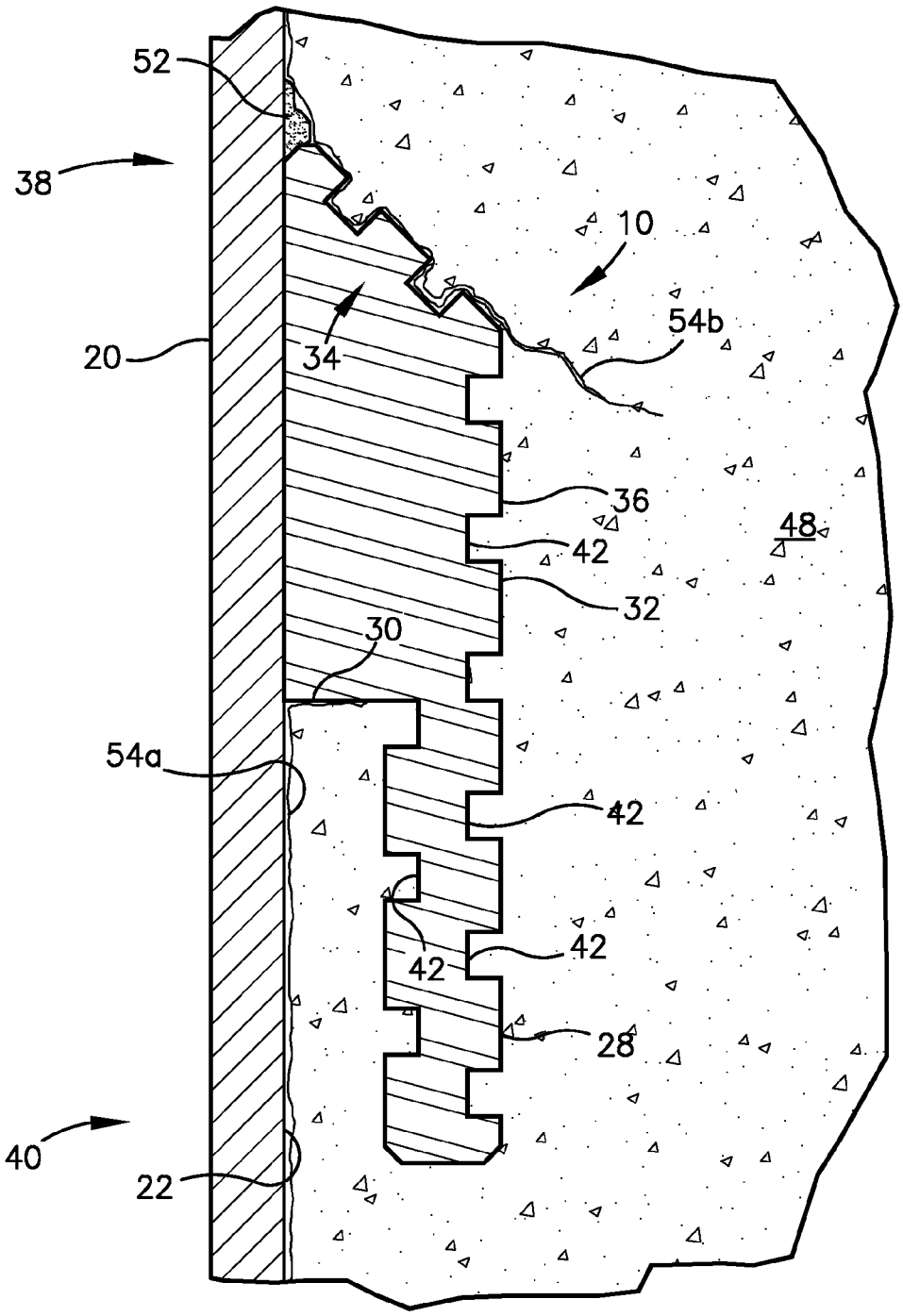
FIG. 5 is a schematic view of a plurality of fluid and crack containment collars installed on a well casing disposed in a borehole and encased in a cement sleeve depicted in accordance with an embodiment of the invention.

With reference now to FIGS. 3-5, installation and operation of the fluid and crack containment collar 10 is described in accordance with an embodiment of the invention. Initially, locations on the well casing 20 at which the collar 10 is to be disposed are identified. The locations are associated with regions of the well casing 20 at which perforation or fracturing is to occur in order to access resources held in geologic formations that will surround the well casing 20 when disposed in a borehole 44. The perforation or fracturing of the well casing 20 and/or of the surrounding geologic formations is conducted by know methods. The location of the collars 10 may be a predetermined distance above and below a perforation or containment zone 46 or might be determined based on locations of geologic formations within the borehole 44, among others.

The collars 10 are preferably employed in pairs with an upper collar 10U coupled to the well casing 20 vertically above the zone 46 and a second collar 10L coupled to the well casing 20 at a location vertically below the zone 46. Installation of the collar 10 is described herein with respect to use associated with containment zones 46 around perforation sites on the well casing 20, however such is not intended to limit embodiments of the invention to a particular application. The upper and lower collars 10U, 10L are inversely oriented relative to one another to direct their second ends 40 toward one another; the upper collar 10U is oriented with the annular wall 28 extending vertically downward, and the lower collar 10L is oriented with the annular wall 28 extending vertically upward.

The collars 10 are coupled to the well casing 20 by an available welding method. In another embodiment, the collars 10 are coupled to the casing 20 by one or more adhesives, glues, fasteners, or the like. The weld between the collar 10 and the casing 20 is preferably completed around the circumference of the first end 38 of the collar 10. The weld can also or alternatively be completed between the exterior surface 22 of the casing 20 and the interior surface 24 of the coupling section 16 and/or the shoulder 30.

Any number of collars 10 can be coupled to the casing 20. Pairs of the collars 10 can be coupled to the casing 20 around a plurality of containment zones 46 or other regions of the casing 20 in which micro-annulus cracks and fluid/gas flow therethrough is to be restrained or contained. Pairs or singular ones of the collars 10 may also be placed along the length of the casing 20 as redundant protections against crack propagation and/or fluid/gas flow therethrough.

After coupling of the collars 10 to the casing 20 as desired, the casing 20 is disposed in the borehole 44. Cement and/or other materials (referred to herein generally as cement 48) may be pumped through the casing 20 by known methods. The cement 48 exits a bottom distal end of the casing 20 and fills a bore space 50 between the borehole 44 wall and the casing 20. The cement 48 thus fills in around the collars 10 and into the channels 42 and the trough 31 between the annular wall 28 and the exterior surface 22 of the casing 20. The well is then completed by known methods to prepare the casing 20 for extraction of the natural resources from the geologic formations and the like.

As shown in FIG. 5, micro-annulus cracks 54 or channels may form between the exterior surface 22 of the casing 20 and the surrounding cement 48 during the completion of the well and/or use thereof due to, for example, expansion and contraction of the casing 20 as a result of changing hydrostatic pressures thereon. The collars 10 aid to prevent or resist propagation of the cracks along the length of the casing 20. The coupling, e.g. a weld 52, between the casing 20 and the collar 10 and/or the abutment of the interior wall 24 of the coupling section 14 are substantially rigid or resilient to resist expansion/contraction of the casing 20 and thus may reinforce the casing 20 against such movement at the weld 52 location. The coupling may also or alternatively flex with the casing 20. For example, a coupling comprising a weld bead may be sufficiently resilient to at least partially deform as the casing 20 expands or contracts.

The collars 10 however may not be otherwise substantially subjected to the expansion/contraction movements of the casing 20. For example, the annular wall 28 is not in direct contact with the casing 20 and thus may not be subjected to the expansion/contraction movements of the casing 20. As such, a bond between the cement 48 and the collar 10 is substantially maintained along the outer surface 32 of the collar 10, the interior surface 26 of the annular wall 28, and the shoulder 30. Accordingly, cracks 54 formed between the casing 20 and the cement 48 are obstructed from propagation along the length of the casing 20 by the presence of the collars 10 thereon and/or at least by the coupling or weld between the collar 10 and the casing 20, e.g. a crack propagating along the length of the casing 20 will intersect with the collar 10 and will be obstructed from further propagation along the length of the casing 20.

As shown in FIG. 4, cracks 54*a*, 54*b* propagating along the casing 20 are met with a blunt face of the shoulder 30 or the first end 38 of the collar 10 that requires the crack propagation to substantially change direction in order to continue. A crack 54*a* encountering the shoulder 30 is preferably halted at the shoulder 30. If the crack 54*a* is able to change direction and propagate radially outward along the shoulder 30, it is further obstructed and required to again change direction by the annular wall 28.

Cracks 54*b* encountering the first end 38 of the collar 10 must change direction to propagate around the first end 38 and along the tapered portion 34 of the collar 10 and any channels 42 therein. The angle of the tapered portion 34 may aid to direct the crack propagation to continue radially outward from the casing 20 in a direction similar to that of the tapered portion 34, e.g. generally at the angle θ. As such, the crack 54*b* can be diverted away from the casing 20 and away from joining or intersecting with other cracks 54*a* formed on an opposite side of the collar 10.

The cracks 54 are further obstructed from propagation along the exterior surface 22 of the collar 20 and interior surface 26 of the annular wall 28 by the retention of the bond with the cement 48. The channels 42 aid to retain a strong bond with the cement 48 by providing additional surface area for bonding and structural features that reinforce the components against relative movements. The channels 42 also provide a more tortuous path along which a crack 54 must propagate.

The collars 10 also aid to prevent or resist fluids or gases from propagation through any micro-annulus cracks 54 or channels that may form. By causing cracks 54 to follow a more tortuous path, fluids and/or gases flowing therethrough are also forced to follow the same tortuous path. The flow of fluids/gases through the cracks 54 may thus be slowed to a desirable extent or eliminated entirely. The trough 31 formed by the annular wall 28 of the collar 10 may further function to capture or contain any fluids/gases flowing through the crack 54*a*.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A fluid and crack containment collar for well casings, the collar comprising:

a cylindrical rigid body having a bore extending substantially axially therethrough, the bore including a first portion and a second portion, the first portion including a first diameter and being configured to slideably receive a well casing therein, the second portion forming an interior surface having a second diameter that is larger than the first diameter;

an annular wall formed along the second portion of the bore between the interior surface and an exterior surface of the body; and a channel in the exterior surface of the body that extends about the circumference of the body, the channel being adapted to at least partially obstruct propagation of a first crack forming substantially between the collar and a cement encasing the collar; and a tapered section formed by the exterior surface of the body in which the exterior surface is oriented at an angle to a central axis of the body, the tapered section being located at an end of the body opposite the annular wall, the tapered section being adapted to direct a second crack propagating along the tapered section substantially between the exterior surface of the collar and the cement in a direction substantially outward and away from a well casing on which the collar is disposed, wherein the first crack and the second crack comprise the same or different cracks.

2. The fluid and crack containment collar of claim 1, wherein a plurality of the channels is provided in the exterior surface of the body.

3. The fluid and crack containment collar of claim 1, further comprising:

one or more second channels in the interior surface of the annular wall and extending about the circumference thereof.

4. The fluid and crack containment collar of claim 1, wherein the angle is between about 30° and about 60°.

5. The fluid and crack containment collar of claim 1, wherein the angle is approximately 45°.

6. The fluid and crack containment collar of claim 1, wherein the body is welded to the well casing.

7. The fluid and crack containment collar of claim 1, wherein the collar comprises a first collar, and a second collar that is the same as the first collar is coupled to the well casing at a location that is spaced apart from the first collar along the length of the well casing, the first collar and the second collar being oppositely oriented to direct their annular walls toward one another.

8. The fluid and crack containment collar of claim 7, wherein one or more of a perforation zone and a fracturing zone in the well casing is positioned between the first collar and the second collar.

9. A fluid and crack containment system for well casings comprising:

a well casing configured for insertion in a borehole for extraction of underground resources, the well casing at least partially radially expanding and contracting during one or more of installation and use of the well casing;

a first rigid collar coupled to the well casing at a first location, the first collar including a first bore extending substantially axially therethrough and receiving the well casing therein, and a first annular wall extending from a first end of the first collar in a first direction that is substantially parallel to the length of the well casing, the first annular wall being spaced apart from the well casing and being substantially isolated from the radial expanding and contracting of the well casing; and a second rigid collar coupled to the well casing at a second location spaced apart from the first location, the second collar including a second bore extending substantially axially therethrough and receiving the well casing therein, and a second annular wall extending from a first end of the second collar in a second direction that is opposite the first direction, the second annular wall being spaced apart from the well casing and being substantially isolated from the radial expanding and contracting of the well casing; and a cement encasing the first collar, the second collar, and at least a portion of the well casing, wherein isolation of the first annular wall and the second annular wall from the expanding and contracting of the well casing maintains a bond between the cement and the first and second annular walls and resists propagation of a crack formed between the well casing and the cement.

10. The system of claim 9, wherein the first collar and the second collar obstruct a flow of one or more fluids or gases through the crack between the well casing and the cement.

11. The system of claim 9, wherein the well casing includes one or more of a perforation or fracture located between the first location and the second location.

12. The system of claim 9, wherein one or both of the first collar and the second collar includes one or more channels in an exterior surface and extending circumferentially about the respective collar.

13. The system of claim 9, wherein one or both of the first collar and the second collar includes one or more channels in an interior surface of the respective first and second annular walls.

14. A method for containing crack and fluid propagation along well casings, the method comprising:

coupling a first collar to a well casing at a first location that is vertically above a containment zone, the first collar including a first bore extending substantially axially therethrough and receiving the well casing therein and including a first annular wall extending vertically downward from a lower end of the first collar, the first annular wall being spaced apart from the well casing;

coupling a second collar to the well casing at a second location that is vertically below the containment zone, the second collar including a second bore extending substantially axially therethrough and receiving the well casing therein and including a second annular wall extending vertically upward from an upper end of the second collar, the second annular wall being spaced apart from the well, the first and the second collars defining the containment zone therebetween;

disposing the well casing in a borehole; and encasing the well casing, the first collar, and the second collar in cement; and obstructing by one or both of the first and second collars a crack propagating substantially between the well casing and the cement, the crack being obstructed from propagating from a location within the containment zone to a location outside the containment zone or from the location outside the containment zone to the location within the containment zone.

15. The method of claim 14, further comprising:

perforating the well casing in the containment zone, the perforating forming one or more apertures in the well casing that extend through a wall of the well casing and through the cement to enable extraction of resources from a surrounding geologic formation.

16. The method of claim 14, further comprising:

obstructing by one or both of the first and second collars a flow of a fluid or a gas from a location within the containment zone to a location outside the containment zone or from the location outside the containment zone to the location within the containment zone, the flow being substantially between the well casing and the cement.

17. The method of claim 14, wherein the first and second collars each include a tapered section in which an exterior surface of the collar is oriented at an angle to a central axis of the body, the tapered section being located at an end of the body opposite the annular wall, and further comprising:

directing a crack propagating along the tapered section substantially between the exterior surface of the collar and the cement in a direction substantially outward and away from the well casing.

* * * * *